United States Patent [19]

Nishizaki et al.

[11] 4,422,500

[45] Dec. 27, 1983

[54] METAL HYDRIDE HEAT PUMP

[75] Inventors: Tomoyoshi Nishizaki, Suita; Minoru Miyamoto, Kusatsu; Kazuaki Miyamoto, Amagasaki; Ken Yoshida, Ibaraki; Katuhiko Yamaji; Yasushi Nakata, both of Osaka, all of Japan

[73] Assignee: Sekisui Kagaku Kogyo Kabushiki Kaisha, Osaka, Japan

[21] Appl. No.: 333,680

[22] Filed: Dec. 23, 1981

[30] Foreign Application Priority Data

Dec. 29, 1980 [JP] Japan ..... 55-185356
May 18, 1981 [JP] Japan ..... 56-75559

[51] Int. Cl.[3] ..... F25D 15/00
[52] U.S. Cl. ..... 165/104.12
[58] Field of Search ..... 62/119, 477, 514; 165/104.12

[56] References Cited

U.S. PATENT DOCUMENTS

| | | | |
|---|---|---|---|
| 4,046,522 | 9/1977 | Chen et al. | 123/3 |
| 4,086,877 | 5/1978 | Henkel et al. | 123/3 |
| 4,088,450 | 5/1978 | Kosaka et al. | 123/3 |
| 4,091,086 | 5/1978 | Hindin et al. | 423/648 R |
| 4,135,371 | 1/1979 | Kesselring et al. | 62/119 X |
| 4,200,144 | 4/1980 | Sirovich | 165/104.12 |
| 4,282,835 | 8/1981 | Peterson et al. | 123/3 |
| 4,372,376 | 2/1983 | Nelson et al. | 165/104.12 |

OTHER PUBLICATIONS

Kikuchi et al. in J. Japan Petrol. Inst., 23, (5), 328–333 (1980).

*Primary Examiner*—Lloyd L. King
*Attorney, Agent, or Firm*—Wenderoth, Lind & Ponack

[57] ABSTRACT

A metal hydride heat pump comprising a first and a second heat medium receptacle having heat media flowing therein and a plurality of closed vessels each containing a hydrogen gas atmosphere and divided into a first chamber having a first metal hydride filled therein and a second chamber having a second metal hydride filled therein, said first and second chambers of each closed vessel being made to communicate with each other so that hydrogen gas passes from one chamber to the other but the metal hydrides do not, and a group of the first chambers of the closed vessels being located within the first heat medium receptacle and a group of the second chambers of the closed vessels being located within the second heat medium receptacle, whereby heat exchange is carried out between the heat media in the first and second heat medium receptacles and the first and second metal hydrides through the external walls of the closed vessels.

5 Claims, 12 Drawing Figures

FLOW OF HEAT MEDIUM 11
18
17a
14
M1H
M2H
19
20
41
42
43
44
17b
17a'
45
46
19'
20'
11'
18'
14'
17b'

M2H
M1H
A
H2
B
E
G
O'
ln PH2
O
F
K
H2
D
C
TH
TO
TM
TO'
TL
TE
TF
TG
TK
1/T

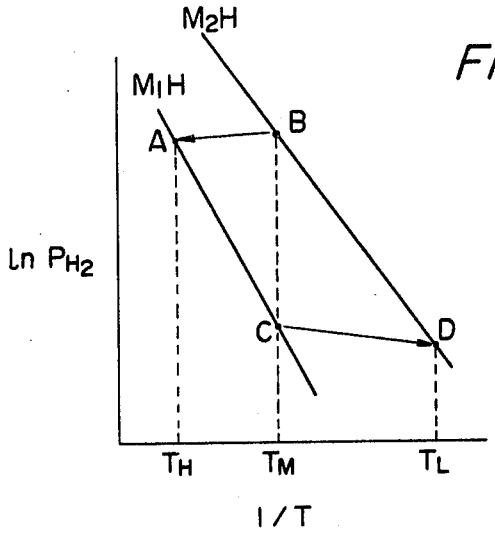
Fig. 9
Fig. 10
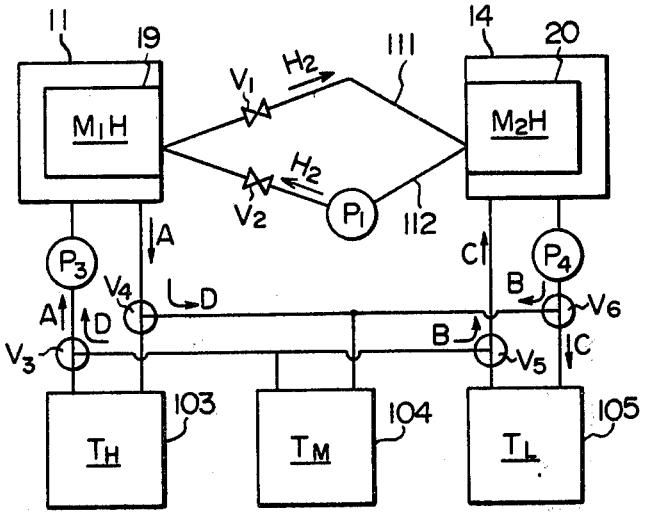

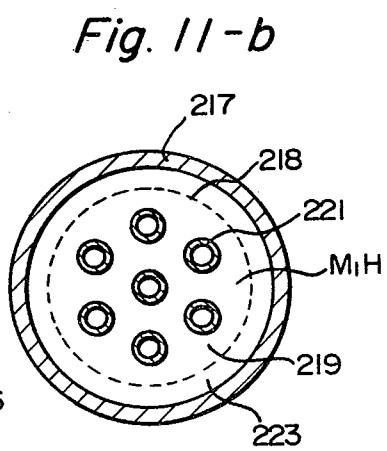
Fig. 11-b
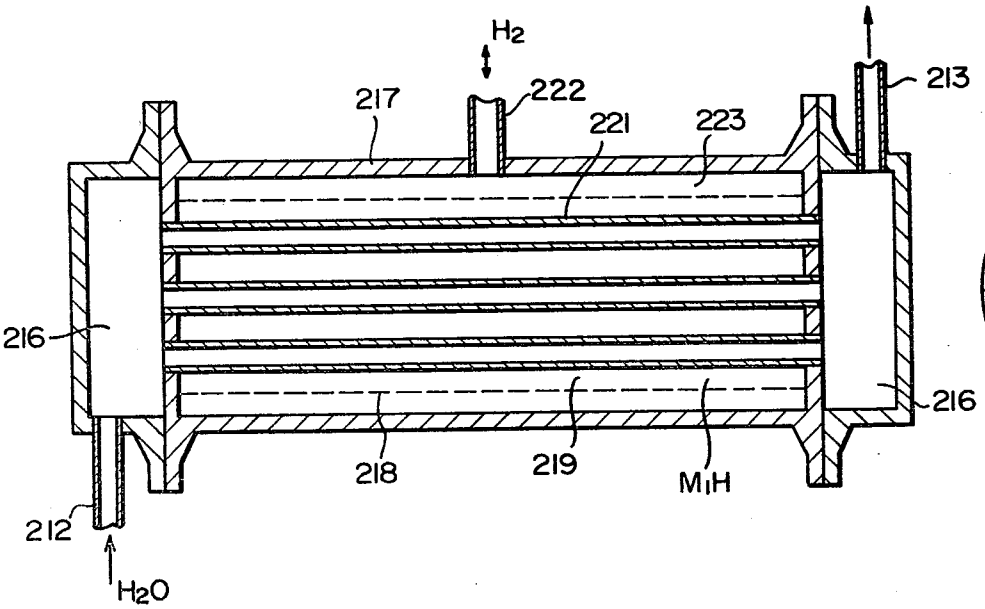
Fig. 11-a

METAL HYDRIDE HEAT PUMP

BACKGROUND OF THE INVENTION

This invention relates to a heat pump device including metal hydrides.

It is known that a certain kind of metal or alloy exothermically occludes hydrogen to form a metal hydride, and the metal hydride endothermically releases hydrogen in a reversible manner. Many such metal hydrides have been known, and examples include lanthanum nickel hydride ($LaNi_5H_x$), calcium nickel hydride ($CaNi_5H_x$), misch metal nickel hydride ($M_mNi_5H_x$), iron titanium hydride ($FeTiH_x$), and magnesium nickel hydride ($Mg_2NiH_x$). In recent years, heat pump devices built by utilizing the characteristics of the metal hydrides have been suggested (see, for example, Japanese Laid-Open Patent Publication No. 22151/1976).

One example of such conventional heat pump devices comprises a first receptacle having filled therein a first metal hydride, a second receptacle having filled therein a second metal hydride, the first and second metal hydrides having different equilibrium dissociation characteristics, a hydrogen flow pipe connecting these receptacles in communication with each other, and heat exchangers provided in the respective receptacles. According to this heat pump device, a heating output and a cooling output based on the heat generation and absorption of the metal hydrides within the receptacle are taken out by means of a heat medium flowing within the heat exchangers. This type of heat pump is called an internal heat exchanging-type heat pump. The receptacles of the conventional heat pump should withstand the pressure generated at the time of hydrogen releasing of the metal hydrides and the total weight of the filled metal hydrides and the heat exchangers. Accordingly, the receptacles have a large wall thickness and a large weight, and become complex in structure.

Furthermore, since in the conventional metal hydride heat pumps, a metal hydride in an amount required per unit time is wholly filled in each receptacle, the reaction of the metal hydride in the receptacle is exceedingly non-uniform, and the loss of heat by radiation from the joint parts of the receptacles including the hydrogen flow pipe, and the loss of heat owing to heat transmission attributed to the temperature difference between the receptacles, markedly reduce the coefficient of performance of the heat pump devices.

According to another conventional practice, two heat pumps of the above structure are provided in juxtaposition and operated with a phase deviation of a half cycle, whereby a cooling output and a heating output can be obtained alternately, and therefore continuously as a whole, from the respective heat pumps.

One example of such a conventional device is shown in FIG. 1. The operating cycle of the device of FIG. 1 for obtaining a cooling output is shown in FIG. 2. FIG. 3 is a temperature distribution chart within a heat exchanger during the operation of the device of FIG. 1.

The device of FIG. 1 is built by filling a first metal hydride $M_1H$ and a second metal hydride $M_2H$ having different equilibrium dissociation characteristics in a first closed receptacle 1 and a second closed receptacle 2 and connecting the two receptacles by a communicating pipe 6 having a valve 5, and similarly connecting closed receptacles 3 and 4 containing $M_1H$ and $M_2H$ respectively by means of a communicating pipe 7. When this device is to be operated to obtain a cooling output, $M_1H$ in the first receptacle 1 [to be abbreviated $(M_1H)_1$] is heated to a temperature $T_H$ by means of a heat exchanger 8 disposed within the receptacle 1 thereby to release hydrogen (point A in FIG. 2). The released hydrogen is sent to the second receptacle 2 through the communicating pipe 6 where $M_2H$ in the second receptacle 2 [to be abbreviated $(M_2H)_2$] exothermically occludes hydrogen (point B in FIG. 2) while being cooled to a temperature $T_M$ by means of a heat exchanger disposed within the receptacle 2. Then, when the heat-exchanging heat transfer media supplied to the heat exchangers 8 and 9 are exchanged and $(M_1H)_1$ is cooled to the temperature $T_M$ (point D in FIG. 2), the difference in equilibrium dissociation pressure between $(M_1H)_1$ and $(M_2H)_2$ causes $(M_2H)_2$ to release hydrogen endothermically and attains a temperature $T_L$, thereby taking away heat from the heat medium in the heat exchanger 9 (point C in FIG. 2). In the meantime, the hydrogen released from $(M_2H)_2$ is occluded exothermically by $(M_1H)_1$. At this time $(M_1H)_1$ is maintained at the temperature $T_M$. Again, the heat media to be supplied to the heat exchangers 8 and 9 are exchanged and the temperature of $(M_2H)_2$ is returned to $T_M$ to start a new cycle. If the above cycle is performed with regard to $M_1H$ in the receptacle 3 [$(M_1H)_3$] and $M_2H$ in the receptacle 4 [$(M_2H)_4$] with a phase deviation of a half cycle, cooling outputs can be obtained alternately from the second receptacle 2 and the fourth receptacle 4.

The driving force for the hydrogen transfer from the point A to B in FIG. 2 is the difference in equilibrium dissociation pressure based on the difference in temperature between $(M_1H)_1$ and $(M_2H)_2$. $(M_1H)_2$ absorbs heat at the time of releasing hydrogen, and $(M_2H)_2$ generates heat at the time of occluding hydrogen. Hence, as shown in FIG. 3, a heat medium at a high temperature is supplied to the heat exchanger 8 in the first receptacle 1 in order to heat $M_1H$ to the temperature $T_H$. Because of the endothermic reaction of $(M_1H)_1$, the temperature decreases progressively from the heat medium inlet toward the outlet of the receptacle 1. Consequently, in the receptacle 1, $M_1H$ existing in the downstream portion of the heat exchanger 8 is heated to a temperature $T_{H'}$, which is lower than the temperature $T_H$. Likewise, a heat medium at a low temperature is supplied to the heat exchanger 9 of the second receptacle 2 in order to cool $(M_2H)_2$ to a temperature $T_M$. Owing to the exothermic reaction of $(M_2H)_2$, the temperature of the heat medium progressively increases from the heat medium inlet toward the outlet of the receptacle 2. Consequently, $M_2H$ existing in the downstream portion of the heat exchanger 9 attains a temperature $T_M$, which is higher than the temperature $T_M$. In this way, the difference in temperature, i.e., the difference in equilibrium dissociation pressure, between the metal hydrides in the downstream portion of the heat-exchanger decreases, and the rate of hydrogen transfer from point A to point B decreases. In some cases, hydrogen transfer might stop locally. This means that the output per unit time is low. In particular, since in a conventional metal hydride heat pump, a metal hydride in an amount which can give the required output per unit time is wholly filled in each receptacle, the reaction of the metal hydride within the receptacle becomes exceedingly non-uniform.

The non-uniformity of the reaction also occurs when hydrogen is transferred from point D to point C in FIG. 2.

SUMMARY OF THE INVENTION

It is an object of this invention therefore to provide a metal hydride heat pump which solves the problems associated with the conventional heat pump devices.

In the heat pump of this invention, a required amount of a metal hydride is filled dividedly in a plurality of receptacles, and unlike the conventional devices, a heat exchanger is not provided within the receptacle. Instead, a heat medium is caused to flow externally of the receptacle, and heat exchange between the heat medium and the metal hydride in the receptacle is carried out through the wall of the receptacle. This type of heat pump is called an external heat exchanging-type heat pump.

According to the heat pump of this invention, the receptacles having metal hydrides filled therein are uniformly heated by heat media, and the hydrogen occluding and releasing reactions of the metal hydrides are performed uniformly. Consequently, the loss of heat is reduced and the output of the device per unit time is increased.

The present invention provides a metal hydride heat pump comprising a first and a second heat medium receptacle having heat media flowing therein and a plurality of closed vessels each containing a hydrogen gas atmosphere and divided into a first chamber having a first metal hydride filled therein and a second chamber having a second metal hydride filled therein, said first and second chambers of each closed vessel being made to communicate with each other so that hydrogen gas passes from one chamber to the other but the metal hydrides to not, and a group of the first chambers of the closed vessels being located within the first heat medium receptacle and a group of the second chambers of the closed vessels being located within the second heat medium receptacle, whereby heat exchange is carried out between the heat media in the first and second heat medium receptacles and the first and second metal hydrides through the external walls of the closed vessels.

In one preferred embodiment of the heat pump of the invention, a plurality of the first chambers having the first metal hydride filled therein are caused to communicate with a plurality of the second chambers having the second metal hydride filled therein through a single passage in such a manner that they permit permeation of hydrogen gas but do not permit permeation of metal hydrides.

In another preferred embodiment of the heat pump of this invention, a heat medium flows in one direction in each of the first and second heat medium receptacles; and the plurality of the closed vessels are sequentially arranged in each of the first and second heat medium receptacles such that with respect to the flowing direction of the heat medium, a first chamber of a closed vessel located on the upstream side of the first heat medium receptacle communicates with a second chamber of a closed vessel located on the downstream side of the second heat medium receptacle, and a first chamber of the closed vessel located on the downstream side of the first heat medium receptacle communicates with a second chamber of the closed vessel located on the upstream side of the second heat medium receptacle.

According to yet another preferred embodiment of the heat pump of this invention, a plurality of units each composed of the first and second heat medium receptacles and a plurality of the closed vessels are provided, and means for performing heat exchange between the heat medium receptacles in one unit and the heat medium receptacles in another unit is provided. In each of the units, after the transfer of hydrogen between the first chamber having the first metal hydride filled therein and the second chamber having the second metal hydride filled therein has been completed, heat exchange is carried out between the heat medium receptacles in said one unit and the heat medium receptacles in said other unit.

According to a further preferred embodiment of the heat pump of the invention, a compressor for pressurizing hydrogen gas in one of the first and second chambers communicating with each other and reducing the pressure of hydrogen gas in the other is used as a means for transferring hydrogen between the first and second chambers.

Some preferred embodiments of the present invention are described below with reference to the accompanying drawings.

BRIEF DESCRIPTION OF THE DRAWINGS

FIG. 9 is a graph for illustrating a different operation cycle from that shown in FIG. 8;

FIG. 10 is a diagrammatic view of yet another example of the heat pump of the invention;

FIG. 11-*a* is a front sectional view showing an example of an internal exchanging-type heat pump used in the Comparative Example given hereinbelow; and FIG. 11-*b* is a side sectional view of the device of FIG. 11-*a*.

DETAILED DESCRIPTION OF THE INVENTION

Figure 4:
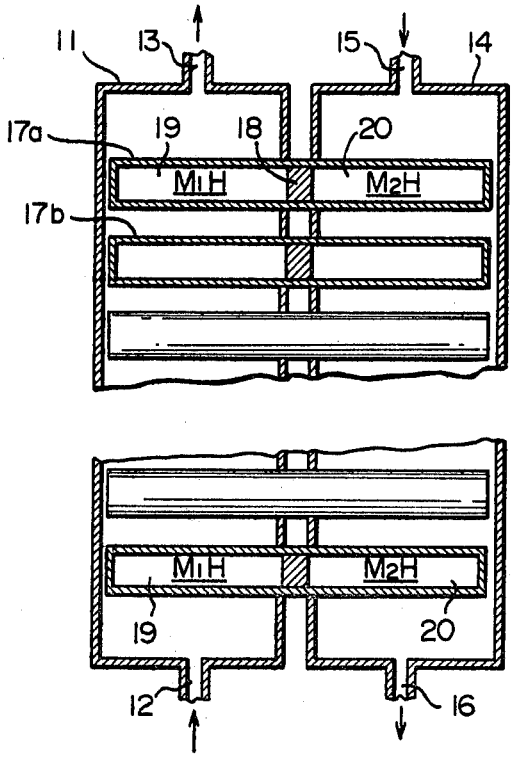
FIG. 4 is a partly broken-away sectional view showing an example of the heat pump of the invention.

The device shown in FIG. 4 is described. A first heat medium receptacle 11 is, for example, of a cylindrical or box-like shape and has an inlet 12 and an outlet 13 for a heat medium disposed axially at opposite ends. A second heat medium receptacle 14 likewise has an inlet 15 and an outlet 16 for a heat medium. A plurality of closed vessels 17*a*, 17*b*, . . . are provided in these heat medium receptacles. Each of the closed vessels is divided by a partitioning wall 18 into a first chamber 19 and a second chamber 20 in such a manner that hydrogen can permeate the partitioning wall 18 but the metal hydrides cannot. The partitioning wall is made of such a material as a sintered porous metallic body, a porous resin sheet, or a metallic mesh. A first metal hydride $M_1H$ is filled in the chamber 19, and a second metal hydride $M_2H$ in the chamber 20.

Instead of providing the partitioning wall, it is possible to disperse and fix a metal hydride in a binder having a bondability to metal hydrides and higher hydrogen permeability, such as natural rubber, polypropylene, polyethylene, or a silicone resin, form it into a pillar-like article for example, and fill the molded article in a closed vessel. According to this embodiment, hydrogen alone can be moved between chambers 19 and 20 by disposing $M_1H$ in the chamber 19 and $M_2H$ in the chamber 20.

According to the heat pump shown in FIG. 4, closed vessels are put in heat medium receptacles instead of providing heat exchangers within the closed vessels, and heat exchange between metal hydrides and heat media is carried out through the walls of the closed vessels. Hence, the closed vessels are light in weight and of simplified shape. This leads to a reduced heat capacity and an increased coefficient of performance.

Furthermore, since a metal hydride in an amount sufficient to obtain the required output is filled dividedly in a plurality of closed vessels, the individual closed vessels are small-sized and the metal hydrides filled therein can be heated or cooled rapidly with reduced variations. Consequently, a higher output per unit time can be obtained than in a conventional device by using the same amount of metal hydride as in the conventional device. Another advantage of filling a metal hydride dividedly in a plurality of closed vessels is that stresses caused by volume expansion and shrinkage upon hydrogen occlusion and releasing are borne dividely by the closed vessels, and the heat transmitting distance from the metal hydride to the wall of the closed vessels becomes very short.

Figure 1:
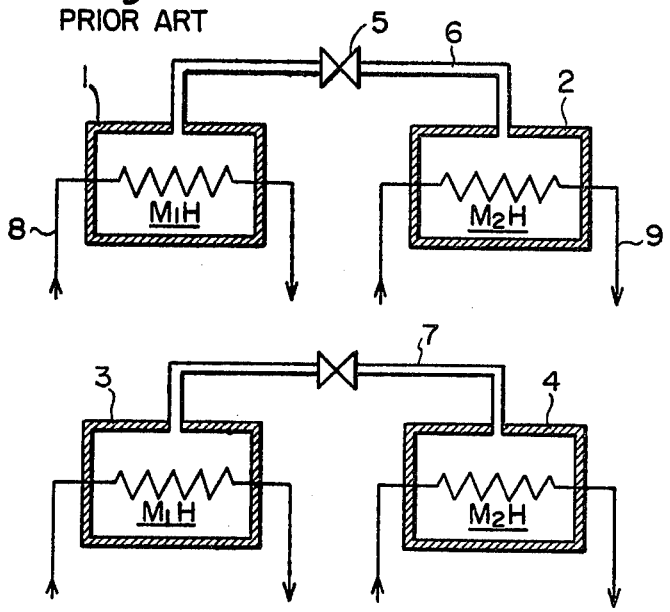
Fig. 1 PRIOR ART
FIGS. 1–3 represent prior art heat pumps as discussed above.
Figure 2:
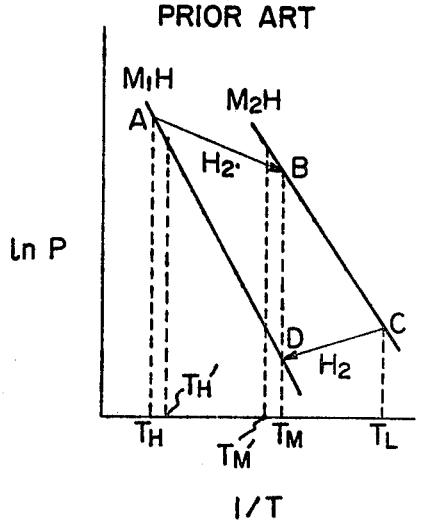
Fig. 2 PRIOR ART
Figure 3:
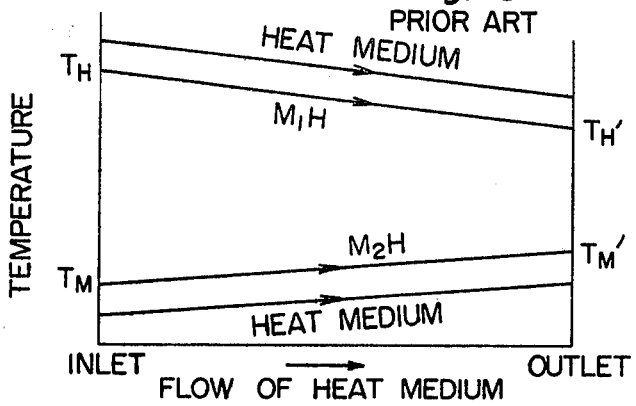
Fig. 3 PRIOR ART

The operation of the heat pump of FIG. 4 for obtaining a cooling output is described with reference to FIG. 2. In FIG. 2, the abscissa represents the reciprocal of an absolute temperature, and the ordinate, the logarithm of the equilibrium dissociation pressure of a metal hydride. Initially, $M_1H$ is in the state of sufficiently occluding hydrogen (point D). Let us assume that initially $M_1H$ is in the state of sufficiently occluding hydrogen (point D), and $M_2H$ is in the state of sufficiently releasing hydrogen (point C). First, a heat medium at a high temperature is passed through the first heat medium receptacle 11 and a heat medium (such as atmospheric air) at a medium temperature is passed through the second heat medium receptacle 14. Thus, $M_1H$ is heated to a temperature $T_H$ to release hydrogen (point A). The released hydrogen permeates the partitioning wall 18 and flows into the second chamber owing to the difference in equilibrium dissociation pressure between the metal hydrides in the first chamber 19 and the second chamber 20. In the second chamber $M_2H$ exothermically occludes hydrogen (point B) while being maintained at the temperature $T_M$ (lower than $T_H$). Then, the heat media supplied to the heat medium receptacles are exchanged, and a heat medium at a medium temperature is passed into the first heat medium receptacle, and a heat medium for cooling loads, into the second heat medium receptacle to cool $M_1H$ to the temperature $T_M$ (point D). As a result, owing to the difference in equilibrium dissociation pressure between $M_1H$ and $M_2H$, $M_2H$ endothermically releases hydrogen and attains a temperature $T_L$ (lower than $T_M$), thus taking away heat from the heat medium for cooling loads (point C). In the meantime, hydrogen released from $M_2H$ is exothermically occluded by $M_1H$ which is kept at the temperature $T_M$. Again, the heat media supplied to the heat medium receptacles are exchanged to heat $M_1H$ to the temperature $T_H$ and $M_2H$ to the temperature $T_M$. Thus, a new cycle is started.

According to a preferred method of operating the heat pump of FIG. 4, the heat medium in the first heat medium receptacle and the heat medium in the second heat medium receptacle flow through the respective heat medium receptacles countercurrently as shown by arrows in FIG. 4. Accordingly, in one of the heat medium receptacles, a closed vessel (e.g., 17*a*) on the downstream side of one heat medium receptacle is located on the upstream side of the other heat medium receptacle.

Figure 5:
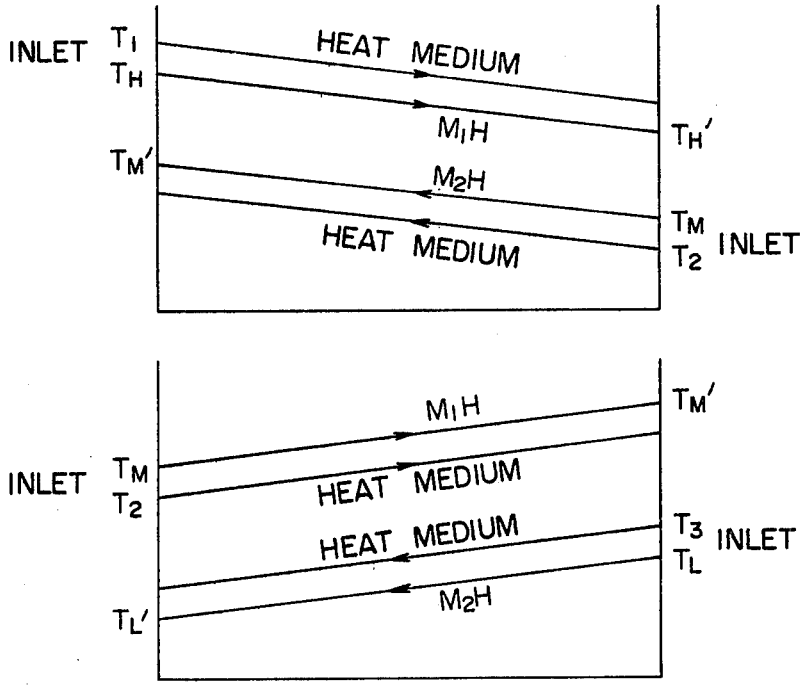
FIG. 5 is a temperature distribution chart of the metal hydrides during the operation of the device of FIG. 4.

When for the purpose of obtaining a cooling output, a heat medium at a temperature $T_1$ is introduced from the inlet of the first heat medium receptacle so as to heat $M_1H$ to the temperature $T_H$ and a heat medium at a temperature $T_2$ is introduced from the inlet of the second heat medium receptacle so as to cool $M_2H$ to a temperature $T_M$, the heat medium decreases in temperature toward the downstream side owing to the absorption of heat upon releasing of hydrogen from $M_1H$, and the temperature at which $M_1H$ is heated decreases toward the downstream side of the heat medium, as schematically shown in FIG. 5. In the meantime, by the generation of heat incident to the occlusion of hydrogen by $M_2H$, the heat medium increases in temperature toward the downstream side, and therefore the temperature at which $M_2H$ is heated increases toward the downstream side of the heat medium. Accordingly, the temperature difference between $M_1H$ of the first chamber and $M_2H$ of the second chamber in each closed vessel is nearly constant ($T_H-T_{M'}$ or $T_{H'}-T_M$) irrespective of the positions of the closed vessels, and in each of the closed receptacles, the metal hydride rapidly and nearly uniformly reacts.

The same can be said when a heat medium at a temperature $T_2$ is supplied to the first heat medium receptacle to cool $M_1H$ to the temperature $T_{M'}$ a heat medium at temperature $T_3$ is supplied to the second heat medium receptacle to exchange heat with a cooling load, and the heat medium for cooling loads is cooled to a temperature $T_L$ by utilizing the absorption of heat at the time of releasing hydrogen from $M_2H$. The heat medium at the temperature $T_M$ increases in temperature toward the downstream side in the heat medium receptacle and the heat medium for cooling loads decreases in temperature toward the downstream side in the heat medium receptacle. Hence, the difference in temperature between the first chamber and the second chamber in each closed vessel is maintained nearly constant ($T_M-T_{L'}$ or $T_{M'}-T_L$).

If two devices shown in FIG. 4 are used as a unit and operated with a phase deviation of a half cycle, an output can be obtained continuously.

The preferred embodiments of the invention have been described above with reference to FIG. 4. The heat pump of this invention can also be designed without providing the closed vessels such that one closed vessel located on the downstream side of one heat medium receptacle in the flowing direction of the heat medium is located on the upstream side in the other heat medium. In this case, the inside of the heat medium receptacle may be partitioned in a direction crossing the axial direction of the closed vessels to form a zig-zag stream of the heat medium. Or it is possible to provide means for stirring the heat medium in the heat medium receptacle to make the temperature distribution of the heat medium uniform.

Figure 6:
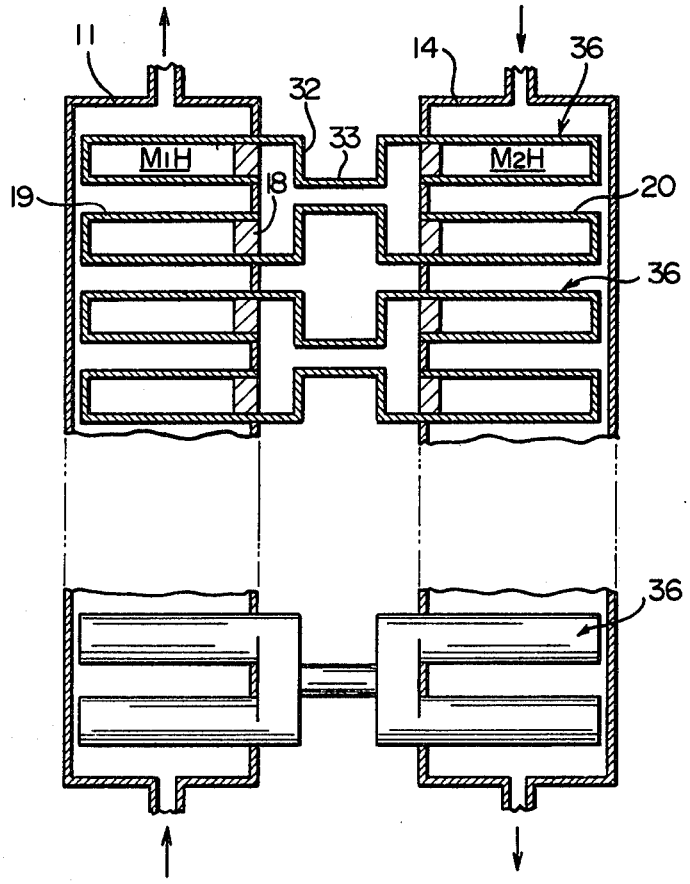
FIG. 6 is a partially broken-away sectional view showing another specific example of the heat pump of the invention.

The heat pump of the invention shown in FIG. 6 is built by connecting two chambers 19 having a first metal hydride filled therein to two chambers 20 having a second metal hydride filled therein by means of a single hydrogen flow pipe 33 through a manifold pipe (bifurcated pipe) 32 to form a unit 36, and disposing a plurality of such units 36 in such a manner that the chambers 19 are located within a first heat medium receptacle 11 and the chambers 20, within a second heat medium receptacle 14. In this embodiment, too, in order to maintain the temperature difference between the chambers 19 and 20 containing the first metal hydride and the second metal hydride substantially constant irrespective of the positions of the chambers within the heat medium receptacles, it is desirable that the directions of flow of the heat media in the first and second heat medium receptacles be made countercurrent.

In the embodiment shown in FIG. 6, a partitioning wall 18 is provided at that part of each chamber which corresponds to the outside wall of each heat medium receptacle. It may, however, be provided at any part of the manihold pipe 32 so long as the metal hydrides do not flow into and out of the first and second chambers. For example, it may be provided at each branching part of the manifold pipe, and in this case, a metal hydride may also be filled in the branching part. Furthermore, in the illustrated embodiment, the manifold pipe is provided outside the heat medium receptacle, but of course, it may be located within the heat medium receptacle.

In the heat pump shown in FIG. 6, a plurality of first chambers are connected to a plurality of second chambers by means of a single hydrogen flow pipe through a manifold pipe instead of connecting each first chamber to each corresponding second chamber by a hydrogen flow pipe. Accordingly, the loss of heat by radiation from the joint part of the first and second chambers or the loss of heat owing to heat transmission by the differences in temperature between the two chambers is reduced, and consequently, the coefficient of performance of the device increases. Moreover, the heat medium becomes turbulent when flowing toward the plurality of first chambers and second chambers, and the heat transmission resistance between the heat medium and the wall of the closed vessels is reduced.

Figure 7:
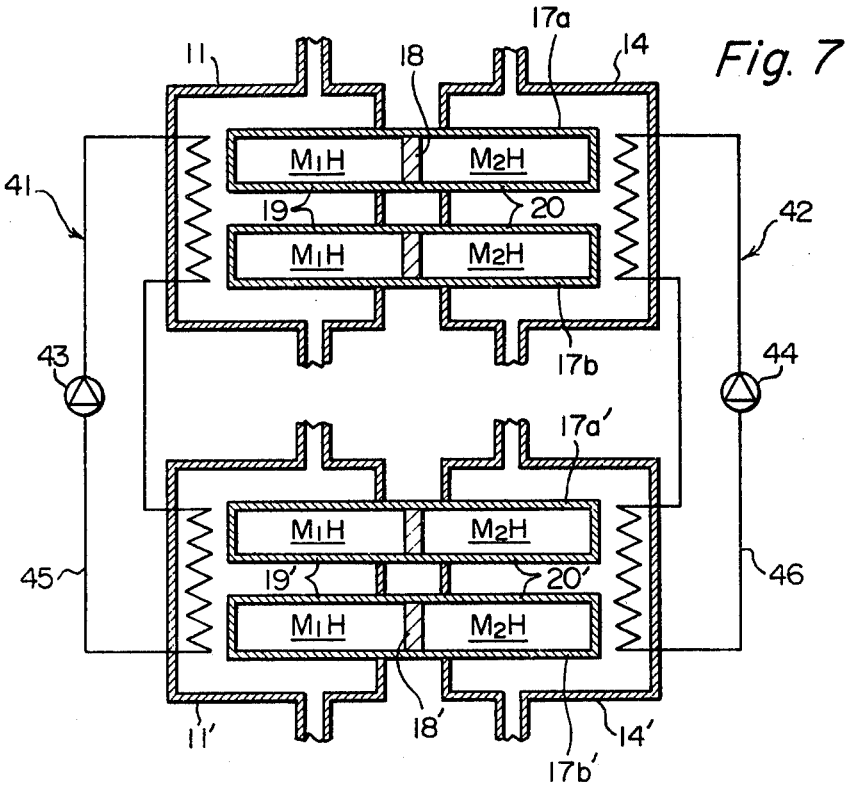
FIG. 7 is a view showing still another embodiment of the heat pump of the invention.

In another embodiment of the invention shown in FIG. 7, a heat pump unit composed of a first heat medium receptacle 11, a second heat medium receptacle 14 and a plurality of closed vessels 17*a*, 17*b*, . . . is disposed in juxtaposition with another heat pump unit composed of a first heat medium receptacle 11', a second heat medium receptacle 14' and a plurality of closed vessels 17*a'*, 17*b'*, . . . A heat exchanging means 41 is provided between the first heat medium receptacles 11 and 11', and a heat exchanging means 42 is provided between the second heat medium receptacles 14 and 14'. The heat exchanging means 41 and 42 are composed of pumps 43 and 44 and fluid (e.g., water) conduits 45 and 46, respectively. The heat exchange may also be carried out by simply exchanging the heat media between the heat medium receptacles 11 and 11' (or 14 and 14').

When heat exchange is performed between the heat medium receptacles in the two heat pump units by means of the heat exchanging means after the transfer of hydrogen between the first and second chambers in each unit is over, the decrease of the coefficient of performance which is due to the heat capacity of the device is limited to a small extent as compared with the case of not performing such heat exchanging.

The coefficient of performance of a cooling output cycle in the device of FIG. 7 without using heat exchanging means 41 and 42 is determined as follows:

The coefficient of performance can be determined from the heat balances in the individual operating steps. For simplification, let us assume that in each chamber, m moles of hydrogen reacts, the heats of reaction of $M_1H$ and $M_2H$ per mole of hydrogen are $\Delta H_1$ and $\Delta H_2$, the heat capacity of each of the chambers 19 and 19' containing $M_1H$ is $J_1$, and the heat capacity of each of the chambers 20 and 20' containing $M_2H$ is $J_2$.

(1) Step of occluding and releasing hydrogen

Figure 8:
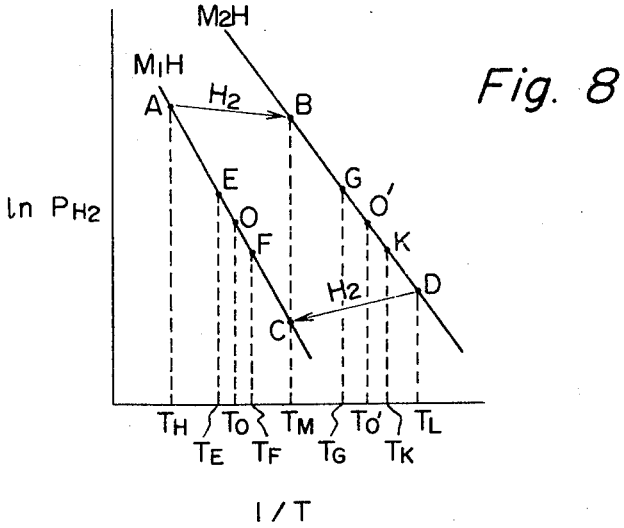
FIG. 8 is a graph showing the temperature characteristics of the equilibrium dissociation pressures of metal hydrides for the purpose of illustrating the operation cycle of a heat pump.

It is understood that in FIG. 8, the chambers 19, 20, 19' and 20' assume the states shown by points A, B, C and D. In the chamber 19, the amount of heat, $Q_1=m\Delta H_1$, is applied by the heat medium receptacle 11 whereby $M_1H$ at temperature $T_H$ releases m moles of hydrogen. The released hydrogen enters the chamber 20 kept at temperature $T_M$ (for example, ambient temperature) through the partitioning wall 18 and is occluded by $M_2H$ to generate heat in an amount $Q_2=m\Delta H_2$. This amount of heat is taken away by a cooler kept at temperature $T_M$.

In the meantime, in the chamber 20', $M_2H$ releases m moles of hydrogen in the course of changing from point B to point D, thereby absorbing heat in an amount of $m\Delta H_2$. Since heat in an amoumt, $Q_3=J_2(T_M-T_L)$, is absorbed in order to cool the chamber 20' itself from temperature $T_M$ to temperature $T_L$, the chamber 20' takes away heat in an amount $Q_4=m\Delta H_2-Q_3$ from the cooling load. Hydrogen released in this step enters the chamber 19' through a partitioning wall 18' and $M_1H$ generates heat in an amount of $\Delta H_1$, which heat is taken away by the cooler.

(2) Step of reversal

If the heat of the atmospheric air is to be used in order to heat the chamber 20' from temperature $T_L$ to temperature $T_M$, and return $M_2H$ from point D to point B, the thermal balance to be considered in this step is the amount of heat, $Q_5=J_1(T_H-T_M)$, which is applied to the chamber 19' from the heat medium receptacle 11' to heat the chamber 19' from temperature $T_M$ to temperature $T_H$ and return $M_1H$ from point C to point A.

(3) Step of hydrogen occlusion and releasing

In this step, the chamber 19' corresponds to the chamber 19 in step (1), and the chamber 20' to the chamber 20 in step (1). Hence, heat in an amount $Q_6=m\Delta H_1$ is supplied to the chamber 19', and the chamber 20 takes away heat in an amount $Q_7=m\Delta H_2-J_2(T_M-T_L)$ from the cooling load.

(4) Step of reversal

This step is for completing the cycle. Thus, heat in an amount $Q_8=J_1(T_M-T_M)$ is applied to the chamber 19 from the heat medium receptacle 11 in order to heat the chamber 19 from temperature $T_M$ to temperature $T_H$ and return $M_1H$ from point C to point A.

From the above analysis, the coefficient of performance COPc of the heat pump as a device for providing a cooling output is given by the following equation.

$$COPc = \frac{Q_4 + Q_7}{Q_1 + Q_5 + Q_6 + Q_8} = \frac{2(m\Delta H_2 - Q_3)}{2(m\Delta H_1 + J_1(T_H - T_M))} \quad \text{(I)}$$

$$= \frac{m\Delta H_2 - J_2(T_M - T_L)}{m\Delta H_1 + J_1(T_H - T_M)}$$

It is seen from the above equation that when the heat exchanging means 41 and 42 are not used, the heat capacities of the chambers which reduce the coefficient of performance are a major influencing factor.

In producing a heating output by the cycle shown in FIG. 9, the chamber 20 at ordinary temperature $T_L$ is heated to temperature $T_M$ by a heat source kept at temperature $T_M$ to release hydrogen. For this purpose, heat in an amount of $J_2(T_M-T_L)+m\Delta H_2$ is supplied to the chamber 22 from a heat source. The released hydrogen is occluded by $M_1H$ at temperature $T_M$ in the chamber 19, whereby the temperature of the chamber 19 reaches $T_H$. If the amount of heat required for heating the chamber 19 itself is $J_1(T_H-T_M)$, the amount of heat supplied to the heating load is $m\Delta H_1-J_1(T_H-T_M)$. Then, the chamber 20 is cooled with the atmospheric air in order to return its temperature to $T_L$. Thus, the chamber 19 releases hydrogen to $M_2H$ at temperature $T_L$ and attains temperature $T_M$. If the heat generated by the hydrogen occlusion of $M_2H$ is taken away by the atmospheric air, the amount of heat required for this operation is $m\Delta H_1 - J_1(T_H - T_M)$. Since the chambers 19' and 20' repeat the above operation with a phase deviation of a half cycle, the coefficient of performance $COP_H$ of this device is given by the following equation.

$$COP_H = \frac{m\Delta H_1 - J_1(T_H - T_M)}{m(\Delta H_1 + \Delta H_2) - J_1(T_H - T_M) + J_2(T_M - T_L)} \quad \text{(II)}$$

In this case, too, it is seen that the heat capacities of the chambers reduce the coefficient of performance of the device.

When the device of FIG. 7 is operated as described hereinabove by using the heat exchanging means 41 and 42, the coefficient of performance of the device is determined in the following manner.

For simplicity, the same conditions as given hereinabove are used, and it is to be understood that the starting point of the operating cycle is when the chambers 19, 20, 19' and 20' are respectively at points C, D, A and B in FIG. 8 and the transfer of hydrogen has been completed.

(1) Step of heat exchange between the chambers

The chamber 19' is heated by means of the heat medium receptacle 11' and kept at temperature $T_H$, and the chamber 19 is cooled to temperature $T_M$ by the heat medium receptacle 11. The heating and cooling of the chambers are stopped, and a pump 43 in a heat exchanging circuit 45 is driven to perform heat exchange between the chambers 19 and 19'. As a result, the chamber 19 is heated to temperature $T_F$, and the chamber 19' is cooled to temperature $T_E$. In other words, $M_1H$ in the chamber 19 changes from point C to point F, and $M_1H$ in the chamber 19', from point A to point E. $T_O$ in FIG. 8 is the temperature which the chambers 19 and 19' would have if heat exchange has been completely done between the chambers 19 and 19', and point 0 represents the state of $M_1H$ corresponding to this temperature. Likewise, heat exchange is performed by means of a heat exchanging circuit 46 between the chamber 20 kept at temperature $T_L$ and the chamber 20' kept at temperature $T_M$. As a result, the chamber 20 is heated to temperature $T_K$, and the chamber 20' is cooled to temperature $T_G$. In other words, $M_2H$ in the chamber 20 and $M_2H$ in the chamber 20' change from points D and B to points K and G, respectively. $T_{O'}$ in FIG. 8 is the temperature which the chambers 20 and 20' would have if heat exchange has been performed completely between these chambers, and point 0' represents the state of $M_2H$ corresponding to this temperature. For simplicity, if the following relation holds good among the temperatures $T_E$, $T_O$, $T_F$, $T_G$, $T_{O'}$ and $T_K$, the value of this equation is the heat exchanging efficiency of the heat exchangers 41 and 42.

$$\eta = \frac{T_H - T_E}{T_H - T_O} = \frac{T_F - T_M}{T_O - T_M} = \frac{T_M - T_G}{T_M - T_{O'}} = \frac{T_K - T_L}{T_{O'} - T_L}$$

Assuming that $T_O = \frac{T_H + T_M}{2}$ and $T_{O'} = \frac{T_M + T_L}{2}$, then $T_F = T_M + \frac{\eta(T_H - T_M)}{2}$ and $T_G = T_M - \frac{\eta(T_M - T_L)}{2}$ (2) Step of heating and cooling the chambers The operation of the pump 43 and the heat exchanging operation are stopped, and the chamber 19 is heated from temperature $T_F$ to temperature $T_H$ by means of the heat medium receptacle 11 whereby $M_1H$ changes from point F to point A. The amount of heat, $Q_{11} = J_1(T_H - T_F)$, required for this heating is supplied to the chamber 19 from the heat medium receptacle 11. In the meantime, the chamber 19' is cooled from temperature $T_E$ to temperature $T_M$ by means of the heat medium receptacle 11' after stopping the operation of the pump 44 and the heat exchanging operation between the chambers.

(3) Step of hydrogen occlusion and releasing

While the chambers 19 are maintained at temperature $T_H$, and the chambers 19', at temperature $T_M$, m moles of hydrogen released endothermically from $M_1H$ in the chambers 19 is caused to flow into the chambers 20 at temperature $T_K$, and simultaneously, m moles of hydrogen released from $M_2H$ in the chambers 20' at temperature $T_G$ is caused to flow into the chambers 19' kept at temperature $T_M$. Accordingly, heat in an amount $Q_{12} = m\Delta H_1$ is applied to the chambers 19 from the heat source, and conversely $M_2H$ in the chambers 20 exothermically occludes hydrogen. Consequently, heat in an amount of $m\Delta H_2$ is generated, and the temperature rises from $T_K$ to $T_M$. Afterward, the temperature of the chambers 20 is maintained at $T_M$ by means of the heat medium receptacle 14.

On the other hand, the chambers 20' endothermically releases m moles of hydrogen and absorbs heat in an amount of $m\Delta H_2$, as stated hereinabove. When the chambers 20' themselves absorb heat in an amount of $J_2(T_G - T_L)$ and attain the temperature $T_L$, these chambers take away heat in an amount of $Q_{13} = m\Delta H_2 - J_2(T_G - T_L)$ from a cooling load through the heat medium receptacle 14'.

A half of one cycle is thus over. In the latter half of the cycle, the same operation is repeated in the different chambers. Thus, the coefficient of performance $COP_C$ of this device is given by the following equation.

$$COP_C = \frac{2Q_{13}}{2(Q_{11} + Q_{12})} = \frac{m\Delta H_2 - J_2(T_O - T_L)}{m\Delta H_1 + J_1(T_H - T_F)} \quad \text{(III)}$$

$$= \frac{m\Delta H_2 - J_2(T_M - T_L)(1 - \eta/2)}{m\Delta H_1 + J_1(T_H - T_M)(1 - \eta/2)}$$

Likewise, the coefficient of performance $COP_H$ in a heating output cycle is given by the following equation.

$$COP_H = \frac{m\Delta H_1 - J_1(T_H - T_M)(1 - \eta/2)}{m(\Delta H_1 + \Delta H_2) - \{J_1(T_H - T_M) - J_2(T_M - T_L)\}(1 - \eta/2)} \quad \text{(IV)}$$

Hence, in the case of using the heat exchanging means 41 and 42, the proportion of the heat capacities of the chambers in the coefficient of performance is reduced by one-half of $\eta$ as compared with the case of not using them. In particular, in the cooling output cycle, the coefficient of performance increases markedly.

In the metal hydride heat pump of the invention, a compressor which pressurizes hydrogen gas in one of the first and second chambers which communicate with each other and reduces the pressure of hydrogen gas in the other may be used as a means for moving hydrogen between the first and second chambers.

One example of the heat pump including such a compressor is diagrammatically shown in FIG. 10. In FIG. 10, the first chamber 19 and the second chamber 20 are connected by means of an ordinary communicating pipe 111 and a communicating pipe 112 equipped with a compressor $P_1$. $V_1$ and $V_2$ represent valves for the communicating pipes 111 and 112, respectively. Heat exchange between the chambers 19 and 20 is performed by means of heat media 103, 104 and 105 maintained at temperatures $T_H$, $T_M$ and $T_L$ respectively. $V_3$, $V_4$, $V_5$ and $V_6$ respectively represent valves for the heat media. $P_3$ and $P_4$ represent pumps for the heat media.

It is to be understood that FIG. 10 is a simplified view and each of the chambers 19 and 20 in fact represents a plurality of chambers, and a plurality of chambers 19 and a plurality of chambers 20 are located within separate heat medium receptacles. While flowing through the heat medium receptacles, the heat media 103, 104 and 105 exchange heat with $M_1H$ of the chambers 19 or $M_2H$ of the chambers 20 through the walls of the chambers 19 or 20.

By using the heat pump shown in FIG. 10, it is possible to move the hydrogen gas forcibly by the compressor to cause the metal hydride in one chamber to occlude hydrogen, take out the resulting heat output by the heat medium 103, cause the metal hydride in the other chamber to release hydrogen, and take out the resulting cooling output by the heat medium 105. The communicating pipe 111 is used to return residual hydrogen in one of the chambers, and the heat medium 104 (e.g., to be supplied from the outer atmosphere) can be used to cool or heat the closed vessels and the heat medium receptacles when hydrogen transfer by means of the compressor has been completed. If the heat pump in FIG. 10 is operated, without using the compressor, in accordance with the cycle shown in FIGS. 8 and 9, the heat pump is the same as those shown in FIGS. 4, 6 and 7.

EXAMPLE 1

Two heat pump units of the type shown in FIG. 4 and each having 50 closed vessels were disposed in juxtaposition, and operated with a phase deviation of a half cycle in order to obtain a cooling output. Each of chambers 19 and 20 was cylindrical in shape with a length of 500 mm, a diameter of 19 mm and a wall thickness of 0.7 mm. The total weight of the 50 chambers 19 or 20 in each heat pump unit was 42 kg. $LaNi_{0.7}Al_{0.3}$ ($M_1H$) in a total amount of 18 kg was filled in the 50 chambers 19 in each heat pump unit, and $LaNi_5(M_2H)$ in a total amount of 18 kg of was filled in the 50 chambers 20 in each heat pump unit. The temperatures $T_H$, $T_M$ and $T_L$ were set at 85° C., 30° C., and 15° C., respectively. The experiment was carried out when the flows of heat media in the heat medium receptacles 11 and 14 were concurrent, or countercurrent.

When the flows of the heat media were concurrent, a cooling output of 1900 kcal/h was obtained, and the coefficient of performance (COP) was 0.35. In the case of the countercurrent flows, a cooling output of 2500 kcal/hr was obtained, and the coefficient of performance was 0.45.

COMPARATIVE EXAMPLE

A comparative experiment was carried out using an internal heat exchanging-type heat pump of the type shown in FIG. 11.

Referring to FIGS. 11-*a* and 11-*b*, seven heat transmitting pipes 221 are provided within a cylindrical receptacle 217, and the ends of each of the pipes 221 are connected respectively to a water supply pipe 212 and a water drainage pipe 213 via spaces 216. A partitioning wall 218 permeable to hydrogen gas but impermeable to metal hydrides is provided within the receptacle 217, and a metal hydride $M_1H$ is filled in a space 219 inwardly of the partitioning wall 218. The reference numeral 222 represents a hydrogen flow pipe and, 223, a space for diffusion of hydrogen. $M_2H$ is filled in a second receptacle having the same shape as the aforesaid cylindrical receptacle in which $M_1H$ is filled. The first and second receptacles are connected to each other by means of a communicating pipe 222 to form a heat pump unit.

Two such heat pump units were arranged in juxtaposition and operated with a phase deviation of a half cycle.

Each receptacle 217 had a length of 500 mm, a diameter of 130 mm and a wall thickness of 5 mm, and weighed 65 kg. 18 kg of $LaNi_{0.7}Al_{0.3}(M_1H)$ or $LaNi_5(M_2H)$ was filled in each receptacle. The heat pump was operated while setting the temperatures $T_H$, $T_M$ and $T_L$ at 85° C., 30° C., and 15° C., respectively. A cooling output of 500 kcal/hr was obtained, and the coefficient of performance was 0.10.

The results obtained in Example 1 and Comparative Example 1 are summarized in the following table.

| Type of the heat pump chamber specification | Internal heat exchanging-type (Comparative Example) | External heat exchanging-type (Example 1) | |
|---|---|---|---|
| | | Concurrent flow | Countercurrent flow |
| Length (mm) | 500 | 500 | |
| Diameter (mm) | 130 | 19 | |
| Wall thickness (mm) | 5 | 0.7 | |
| Number of chambers | 1 | 50 | |
| Total weight per heat pump unit (kg) | 65 | 42 | |
| Total weight of metal hydrides per heat pump unit (kg) | 18 | 18 | |
| COP | 0.10 | 0.35 | 0.45 |
| Output (kcal/hr) | 500 | 1900 | 2500 |

The external heat exchanging-type heat pump of the invention has the following advantages over the internal heat exchanging-type heat pump of the Comparative Example.

Firstly, the weight of receptacles in which metal hydrides are filled can be decreased. Hence, the heat capacity of the receptacles is reduced and the performance of the heat pump is improved. The decreased weight of the receptacles in the external heat exchanging-type heat pump is due mainly to the fact that heat media flowing externally of the receptacles have a low pressure, and that because the individual receptacles have a small diameter and the stress caused by expansion and shrinkage of the metal hydride is low, the thickness of the receptacles can be reduced.

Secondly, if the sizes of the receptacles in these two types of heat pumps are nearly the same, the heat pump of the external heat exchanging type has a larger heat transmitting area and the heat transmitting distance between the metal hydride and the wall of the closed vessel is short. If the number of heat transmitting pipes is increased in the internal heat exchanging-type heat pump in an attempt to increase the heat transmitting area, the receptacles must be made larger as a whole in order to provide spaces in which to fill metal hydrides, and become complex in structure.

The device of the present invention described hereinabove does not have heat exchangers within closed vessels, and heat exchange between the closed vessels and heat media is carried out by utilizing the vessel walls as a heat transmitting surface. Accordingly, the vessels are light in weight and simple in structure, and the heat capacity of the vessels decreases to increase the coefficient of performance of the device. Furthermore, since metal hydrides in an amount sufficient to obtain the required output per unit time is dividedly filled in a plurality of closed vessels, each of the closed vessels is uniformly heated or cooled by a heat medium, and in all of the closed vessels, the hydrogen occlusion and releasing reactions of metal hydrides take place uniformly and rapidly. Consequently, a higher output can be obtained per unit time by using the same amount of metal hydrides as in a conventional device.

Furthermore, instead of connecting each pair of corresponding first and secon closed chambers by means of a hydrogen flow passage, a plurality of first closed chambers are connected to a plurality of second closed chambers by means of a single hydrogen flow passage through manifold pipes in the device of the invention. As a result, the loss of heat by radiation from the joint portions between the closed chambers or the loss of heat owing to heat transmission caused by the difference in temperature between the closed chambers is reduced, and the coefficient of performance of the device increases.

If closed vessels are arranged such that with respect to the flowing direction of a heat medium, a first chamber of a closed vessel located on the upstream side of a first heat medium receptacle communicates with a second chamber of a closed vessel located on the downstream side of a second heat medium receptacle, $M_1H$ and $M_2H$ filled respectively in the first and second chambers of each closed vessel are heated or cooled such that they have a nearly equal temperature difference irrespective of the positions of the closed vessels in the heat medium receptacles. Thus, the hydrogen occluding and releasing reactions of metal hydrides take place uniformly and rapidly in all of the closed vessels. Consequently, the output of the device per unit time per unit weight of metal hydride can be increased. In other words, the device can be operated even when the temperature difference between heat media supplied to the heat medium receptacles is small, and the efficiency of operation increases. Furthermore, the amount of metal hydrides can be smaller per unit output, and the device can be built in a smaller size.

According to still another embodiment of the invention, a plurality of heat pump units each of which is composed of a first and a second heat medium receptacle and a plurality of closed vessel are provided, and means for performing heat exchange between the heat medium receptacle of one heat pump unit and the heat medium receptacle in another unit is used in operating the device. As a result, the effect of the heat capacity of the closed vessels upon the coefficient of performance is reduced, and therefore, the coefficient of performance of the device increases.

In yet another embodiment of the invention, a compressor for pressurizing hydrogen or reducing the pressure of hydrogen is provided as a means for transferring hydrogen between the first and second chambers. As a result, the heat pump can be operated without dependence on heat.

What is claimed is:

1. A metal hydride heat pump comprising a first and a second heat medium receptacle having heat media flowing therein and a plurality of closed vessels each containing a hydrogen gas atmosphere and divided into a first chamber having a first metal hydride filled therein and a second chamber having a second metal hydride filled therein, said first and second chambers of each closed vessel communicating with each other so that hydrogen gas passes from one chamber to the other but the metal hydrides do not, and a group of the first chambers of the closed vessels being located within the first heat medium receptacle and a group of the second chambers of the closed vessels being located within the second heat medium receptacle, whereby heat exchange is carried out between the heat media in the first and second heat medium receptacles and the first and second metal hydrides through the external walls of the closed vessels, wherein a heat medium flows in one direction in each of the first and second heat medium receptacles, and wherein the plurality of the closed vessels are sequentially arranged in each of the first and second heat medium receptacles such that with respect to the flow direction of the heat medium, a first chamber of a closed vessel located on the upstream side of the first heat medium receptacle communicates with a second chamber of a closed vessel located on the downstream side of the second heat medium receptacle, and a first chamber of the closed vessel located on the downstream side of the first heat medium receptacle communicates with a second chamber of the closed vessel located on the upstream side of the second heat medium receptacle.

2. The heat pump of claim 1 wherein a plurality of the first chambers having the first metal hydride filled therein communicate with a plurality of the second chambers having the second metal hydride filled therein through a single passage in such a manner that they permit permeation of hydrogen gas but do not permit permeation of metal hydrides.

3. The heat pump of claim 1 or 2 wherein a plurality of units each composed of the first and second heat medium receptacles and the plurality of the closed vessels are provided, and means for performing heat exchange between the heat medium receptacles in one unit and the heat medium receptacles in another unit is provided, and wherein in each of the units, after the transfer of hydrogen between the first chamber having the first metal hydride filled therein and the second chamber having the second metal hydride filled therein has been completed, heat exchange is carried out between the heat medium receptacles in one said unit and the heat medium receptacles in another said unit.

4. The heat pump of claim 3 which further comprises a compressor for pressurizing hydrogen gas in one of the first and second chambers and reducing the pressure of hydrogen gas in the other as a means for transferring hydrogen between the first and second chambers.

5. The heat pump of claim 1 or 2 which further comprises a compressor for pressurizing hydrogen gas in one of the first and second chambers and reducing the pressure of hydrogen gas in the other as a means for transferring hydrogen between the first and second chambers.

* * * * *